United States Patent [19]

Capra et al.

[11] 4,174,055

[45] Nov. 13, 1979

[54] NON-AEROSOL PRESSURE DISPENSER

[75] Inventors: Nicholas G. Capra, East Hanover, N.J.; Ronald L. Antenore, Coral Gables, Fla.

[73] Assignee: James D. Pauls & J. Claybrook Lewis & Associates, Ltd., Miami, Fla.

[211 Appl. No.: 789,551

[22] Filed: Apr. 20, 1977

[51] Int. Cl.[2] ..... B67D 5/32

[52] U.S. Cl. ..... 222/319; 222/397; 222/340

[58] Field of Search ..... 222/322, 321, 387, 340, 222/318, 341, 384, 385, 319, 397, 257, 258; 239/333

[56] References Cited

U.S. PATENT DOCUMENTS

| | | | |
|---|---|---|---|
| 2,341,031 | 2/1944 | Flynn | 222/387 X |
| 2,342,288 | 2/1944 | Mai | 222/384 |
| 3,299,960 | 1/1967 | Stern | 222/397 |
| 3,797,748 | 3/1974 | Nozawa et al. | 220/340 X |
| 3,921,861 | 11/1975 | Kondo | 222/340 X |

*Primary Examiner*—Stanley H. Tollberg
*Attorney, Agent, or Firm*—Dennis H. Lambert

[57] ABSTRACT

A non-aerosol pressure dispenser includes a pressurization chamber having a piston reciprocable therein and a manual actuator extends from outside the chamber into operative association with the piston. The actuator is reciprocable in a first direction to move the piston to compress a spring engaged therewith and to draw material into the chamber. The spring urges the piston in a second direction to pressurize the material in the chamber and a discharge valve or nozzle is connected with the chamber to release the pressurized contents thereof over a desired prolonged period of time and at a sufficient pressure to obtain a fine mist of the material.

20 Claims, 10 Drawing Figures

NON-AEROSOL PRESSURE DISPENSER

BACKGROUND OF THE INVENTION

This invention relates in general to dispensers for dispensing materials under pressure, and in particular, relates to such a dispenser which relies upon a mechanical means for the pressure source.

The use of some chemical propellants in aerosol dispensers has come under increasing criticism in recent years, and in fact, the potential damage to the environment caused by the propellants used in aerosol dispensers has resulted in legislation being passed in many areas preventing or prohibiting the use of such propellants in dispensing devices after a specified date. Of course, potential harm to the environment, and specifically the ozone layer in the atmosphere, is only one of the disadvantages of propellants used in dispensing devices. Other disadvantages relate to the dangerous nature of the pressurized containers, which must be handled carefully and not stored at elevated temperatures or punctured or incinerated by the user, since an explosion may result.

The present invention uniquely solves the problems presented by prior art aerosol devices, in that it does not rely upon the use of pressurized gases which may be harmful to the environment and does not store material under pressure, such that an explosion could occur under certain conditions. In the present invention, a pressurization chamber or reservoir has a piston reciprocable therein and means extends into the reservoir into operative association with the piston for moving the piston in a first direction to draw material from a container into the reservoir. Movement of the piston in the first direction compresses a spring or other compressible or yieldable means, such that the piston is urged in a return or second direction under pressure against the material drawn into the reservoir, and subsequent operation of a valve or spray nozzle enables escape of the material pressurized by the piston to obtain a fine spray mist for a prolonged period of time. The reservoir and operating means associated therewith can be easily attached to and removed from a container of conventional construction, if desired, whereby the container may be refilled with a material to be dispensed. Moreover, the unique pressure dispenser of the invention operates for a longer period of time and obtains a finer mist than prior art devices of the pump type or squeeze type, which only dispense in short bursts, as determined by the amount of time it takes the finger to push the plunger down, and which also produce uneven sprays of the material being dispensed.

Other prior art devices utilize various constructions to obtain prolonged discharge time or increased pressure by the use of hydraulic or pneumatic pressure advantages. However, such prior art devices are relatively complex and expensive in construction and manufacture, or are difficult and clumsy to operate.

With the present invention, the dispenser is economical to manufacture because of the simplicity in construction thereof, and the problem of user fatigue is eliminated due to the simple manner in which the device is operated. In other words, a plunger is pulled once to charge the reservoir with an amount of material, and the discharge or spray nozzle is then easily operated with the finger to obtain a prolonged, high pressure discharge or spray of the material.

Additionally, many prior art devices can only be used with a specially designed container, and some such devices are not refillable. With the present invention, the reservoir and dispensing means can be used with many conventional containers of glass, plastic or metal and the like, and the containers are easily refillable.

OBJECTS OF THE INVENTION

It is, therefore, an object of the invention to provide an economical and simple construction for a high pressure spray discharge device which utilizes a mechanical means for pressurizing the material to be dispensed, and wherein a prolonged discharge time is obtained with a single operation of the charging device.

A further object of the invention is to provide a dispensing device for discharging a spray or mist of material wherein an accumulating reservoir or chamber is provided for accumulating under pressure a quantity of material to be dispensed through a spray nozzle and wherein a spring means is used to pressurize and discharge the material from the chamber or reservoir, and wherein an actuator for charging material into the chamber is manipulated by a simple pulling force or action exerted thereon.

Another object of the invention is to provide a mechanically operated pressure dispensing device for discharging materials over a prolonged period at a relatively high pressure, wherein the device may be readily attached to and removed from existing conventional containers for use with available containers and also to enable ready refill of the containers with the material to be discharged.

A still further object of the invention is to provide a dispensing device which includes a simple mechanism for charging an accumulating chamber with material under pressure to be discharged, and which utilizes a spray nozzle for effecting discharge of the material from the chamber over a prolonged period of time with a single operation of the discharge nozzle, thereby eliminating the problem of finger or user fatigue found with many prior art devices.

DETAILED DESCRIPTION OF THE INVENTION

Figure 1:
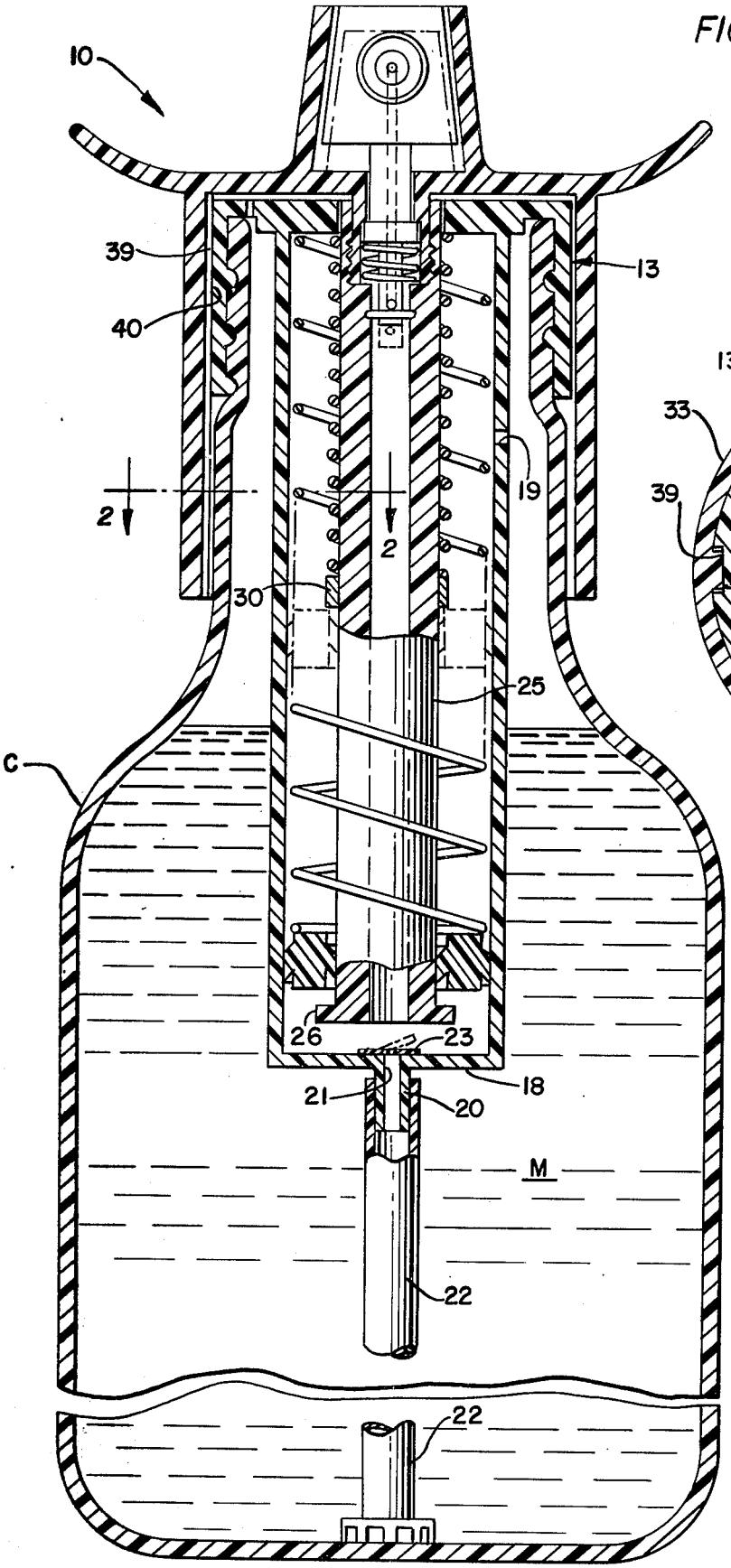
FIG. 1 is a vertical sectional view of a first form of container and discharge device in accordance with the invention, showing the parts in their normal at-rest position.
Figure 2:
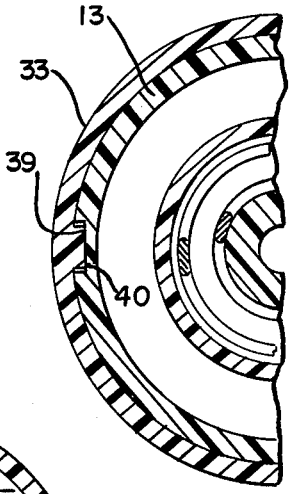
FIG. 2 is a fragmentary view in section taken along line 2—2 in FIG. 1.
Figure 3:
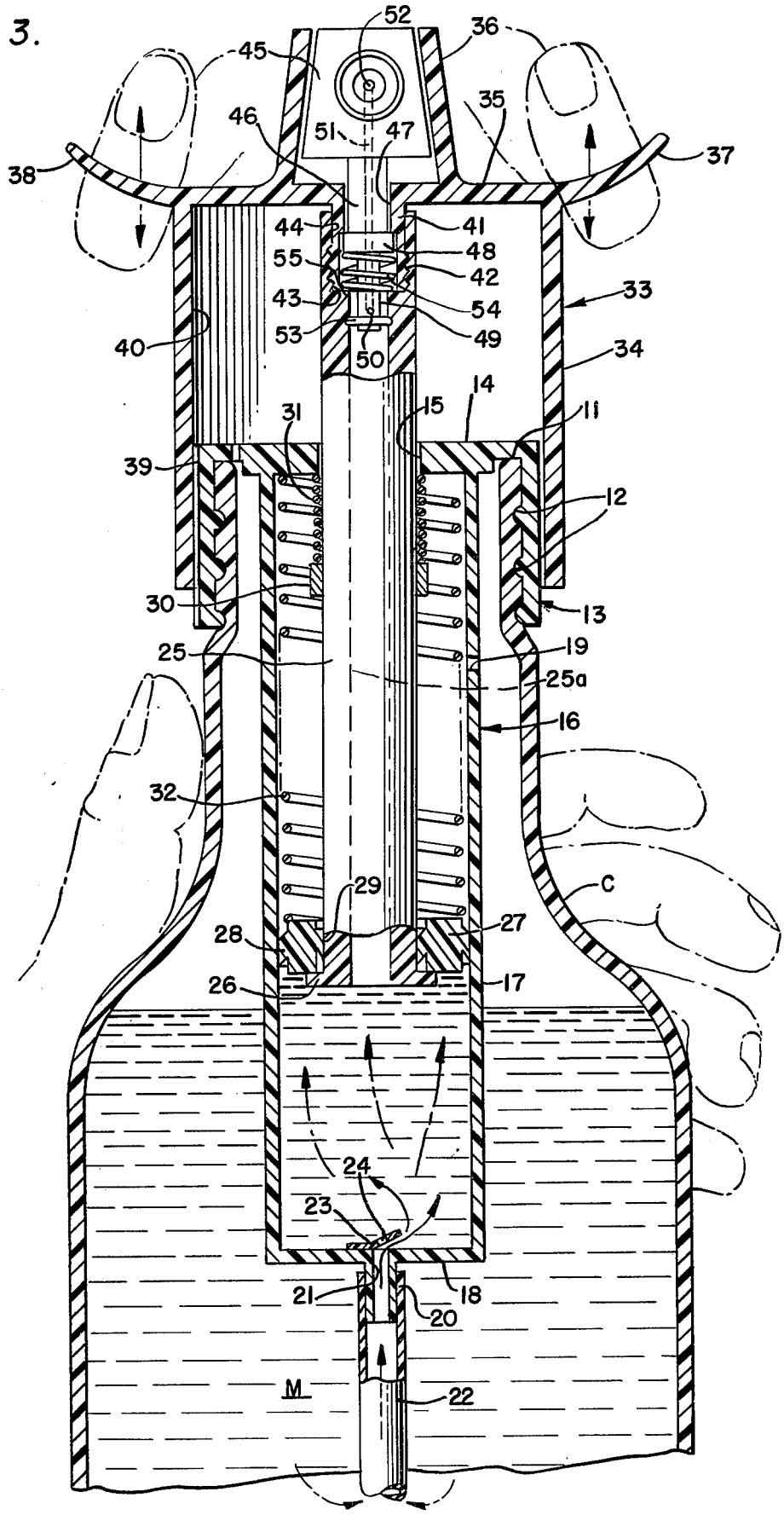
FIG. 3 is a fragmentary vertical sectional view of the device of FIG. 1, showing the pull cap or charging actuator moved to an upwardly or outwardly telescoped relation relative to the container in order to move the piston in the accumulating chamber or reservoir to charge material into the reservoir.

In the drawings, wherein like reference numerals indicate like parts throughout the several views, a dispensing device 10 in accordance with the first form of the invention is shown in FIGS. 1-3 assembled to a container C for discharge of a material M from the container. The container has an open upper end 11 externally threaded at 12 for cooperation with mating threads on a cap 13 of the dispensing device 10. The cap 13 has a top wall 14 with a central opening 15 therethrough and a depending cylindrical accumulating chamber or reservoir 16 having a desired diameter and length, depending upon the container with which the dispensing device is to be used.

The accumulating chamber or reservoir 16 has a side wall 17 and a bottom wall 18. A recirculating opening 19 is formed in the side wall 17 adjacent the upper end thereof and a downwardly projecting, reduced diameter boss or nipple 20 is formed in the bottom wall 18 and a bore 21 extends therethrough. A dip tube 22 is secured at its upper end on the nipple 20 and extends at its lower end to adjacent the bottom of the container C. A flap valve 23 is secured on the bottom wall 18 in overlying relationship to the opening 21, such that when the flap valve is closed, flow downwardly through the opening 21 is prevented. A bleed opening 24 is formed through the flap valve 23 for enabling slow leakback of the material from the accumulating chamber or reservoir through opening 21 and to the container C. The opening 19 in side wall 17 of the chamber or reservoir 16 enables the container to be completely filled at the time of manufacture or upon refilling the same, with the material actually extending upwardly into the neck of the container and through the opening 19 into the accumulating chamber or reservoir 17 to fill the reservoir space itself.

A tubular actuating rod 25 extends through the opening 15 in top wall 14 of cap 13 and has a radially enlarged diameter flange 26 on the lower end thereof which serves to retain an annular piston 27 on the actuating rod or stem 25. The piston 27 has suitable outer seal means 28 thereon for sliding sealing enagement with the interior surface of side wall 17 of chamber or reservoir 16 and similar suitable seal means 29 on the inner surface thereof for sliding sealing cooperation with the outer surface of actuator stem or rod 25. As illustrated in the drawings, the inner and outer seals 29 and 28 are tapered lips or flanges which effect a stronger seal with upward pressure thereagainst, but it is to be understood that these seals could comprise O-rings or other suitable sealing means conventional in the art, if desired. A collar 30 is fixed to the rod 25 between the ends thereof and a spring 31 is engaged between the collar and the undersurface of top wall 14 of cap 13 for urging the rod or stem 25 in a downward direction. A second spring 32 is engaged between the piston 27 and the underside of top wall 14 of cap 13 to urge the piston 27 in a downward direction relative to the stem or rod 25 and causing the piston to normally abut against the flange 26 on the end of rod 25.

An actuator pull cap 33 is slidably telescopically received over the cap 13 and reduced diameter neck portion of container C and includes a cylindrical side wall or skirt 34 and upper or top wall 35 having an upstanding central wall 36 thereon. A pair of outwardly projecting finger grip portions or wings 37 and 38 are formed on the overcap 33 at the upper end thereof to facilitate grasping the overcap and pulling it upwardly to pull the rod 25 upwardly in chamber 16 and thus pull the piston 27 upwardly, whereby springs 31 and 32 are compressed and material M is drawn into the reservoir below the piston 27. A channel 39 is formed in the outer surface of the cap 13 at one side thereof for cooperation with a rib 40 on the inner surface of the overcap 33 to guide the overcap in its reciprocating movement relative to the cap 13 and container C. The overcap 33 includes a downwardly projecting boss 41 on the underside of top wall 35 thereof and the boss 41 is externally threaded at 42 for mating cooperation with threads 43 in the interior surface of an enlarged diameter undercut portion 44 of the upper end of rod 25, whereby when the actuator or overcap 33 is moved upwardly, the rod or stem 25 is also moved upwardly.

A spray nozzle or discharge device 45 is reciprocably received in the upstanding wall 36 and has a downwardly projecting stem 46 thereon slidably received in the bore 47 in boss 41 of overcap 33. The stem 46 has an enlarged collar 48 between the ends thereof and a reduced diameter lower end portion 49 which extends into the bore **25*a* through the tubular stem or rod 25. The reduced diameter portion 49 of stem 46 has a lateral opening 50 therethrough which communicates with an axial passage 51 extending upwardly through the stem to a discharge orifice 52, and the lateral opening 50 is normally closed by a seal ring 53 positioned in the bore 25*a* adjacent the upper end thereof. A spring 54 is engaged between an axially facing shoulder 55 at the lower end of enlarged diameter portion 44 in rod or stem 25 and the collar 48 on stem 46 to normally maintain the discharge device 45 in an upward position, as seen in FIGS. 1 and 3, for example. However, when the discharge device or spray nozzle 45 is engaged with the finger and moved downward to the dotted line position seen in FIG. 1, the lateral opening 50 is beneath the seal 53 and thus the pressurized material in the accumulating chamber beneath the piston 27 communicates with the passage 51** for discharge from the container as desired.

In operation, the container C is filled with a suitable material M and the dispensing device 10 is attached to the container. When it is desired to discharge a quantity of material, the overcap 33 is grasped and moved upwardly relative to the container C, thereby causing the rod 25 to move upwardly which carries with it the piston 27. Upward movement of the piston 27 lowers the pressure in the accumulating chamber 16, causing the flap valve 23 to open and material to be drawn through the dip tube 22 into the accumulating chamber. This upward movement of the overcap 33 results in compression of both springs 31 and 32. Accordingly, subsequent release of the overcap 33 enables the spring 31 to urge the rod 25 and overcap 33 downwardly to the position seen in FIG. 1. However, the material which has been drawn into the accumulating chamber through the flap valve 23 would be pressurized upon initiation of downward movement of the rod 25 and piston 27, and the flap valve 23 will close, whereby the piston 27 will not move downwardly any further in the accumulating chamber, but will instead stay in an upper position, as indicated in phantom lines in FIG. 1, with the spring 32 acting thereon serving to pressurize the material trapped between the piston and the valve 23 in the accumulating chamber 16. Subsequent operation of the discharge nozzle or spray device 45 places the opening 50 and passageway 51 in communication with the material trapped beneath the piston, enabling its escape and the spring then moves the piston downwardly, whereby the material is continuously pressurized until it is all discharged from the accumulating chamber.

During upward movement of the piston, any material which is trapped in the accumulating chamber behind the piston will pass through opening 19 in the side wall of the chamber and return to the container. Also, in the event the accumulating chamber or reservoir is charged with material as indicated in FIG. 3 and a subsequent dispensing or discharge operation of the material is not effected, the material will nonetheless slowly leak back through opening 24 in flap valve 23 into the container, thereby eliminating danger of someone picking up the container and effecting an unexpected discharge or spray of the material by depressing the spray valve or nozzle 45.

Figure 4:
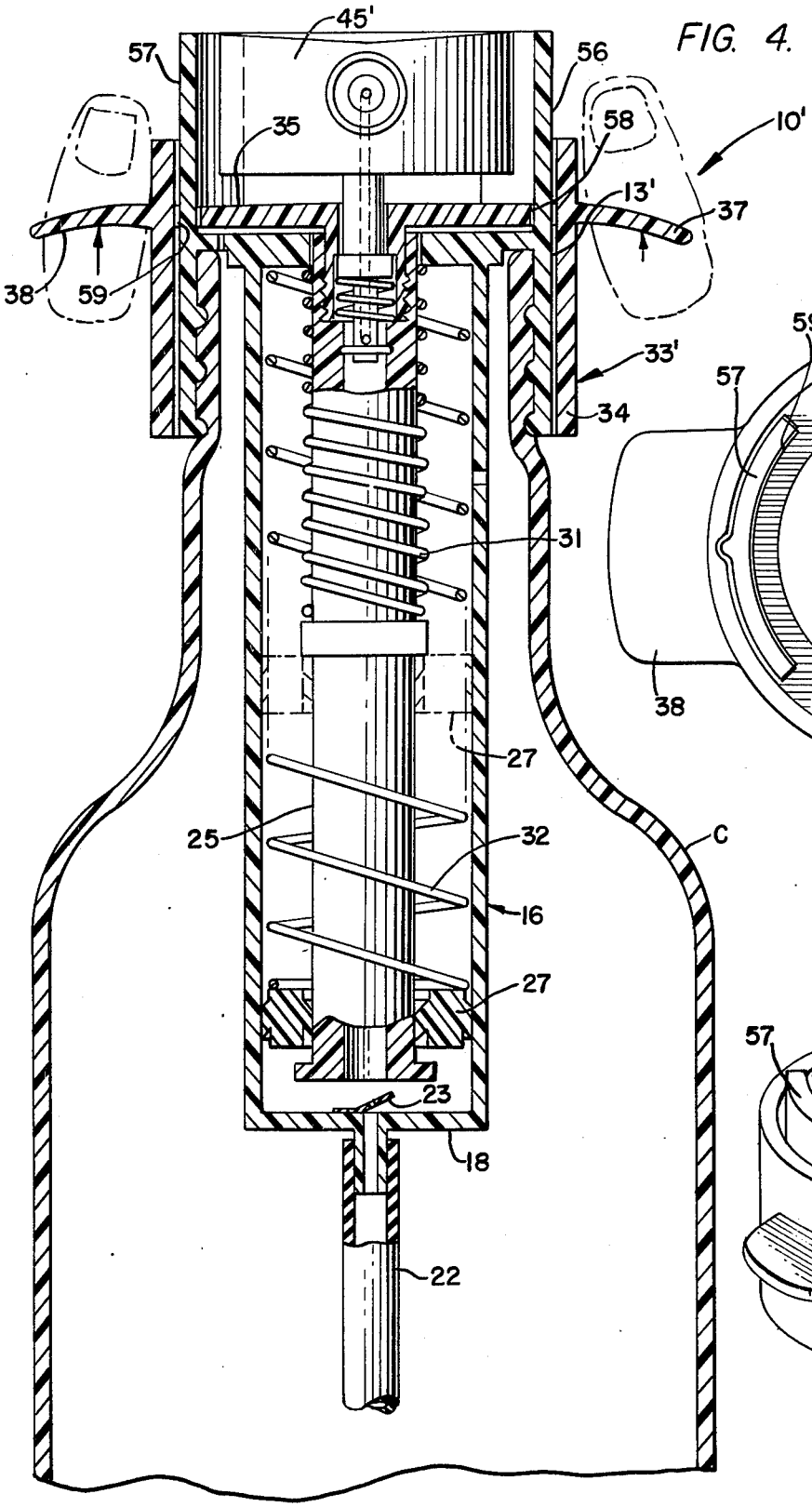
FIG. 4 is a view similar to FIG. 3 of a second form of the invention showing the pull cap or actuator about to be moved outwardly to move the piston upwardly to charge material into the accumulating chamber or reservoir.
Figure 5:
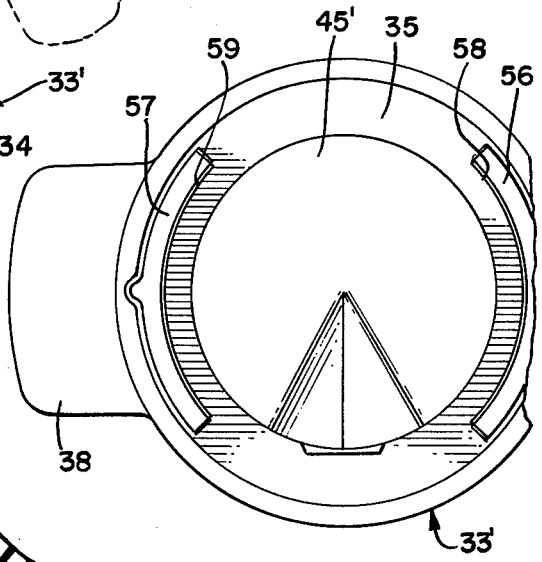
FIG. 5 is a fragmentary plan view of the apparatus in FIG. 4.
Figure 6:
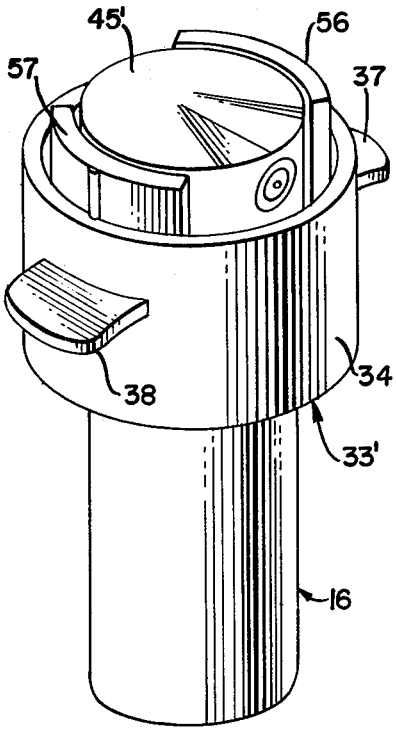
FIG. 6 is a perspective view of the dispensing device of FIG. 4.
Figure 7:
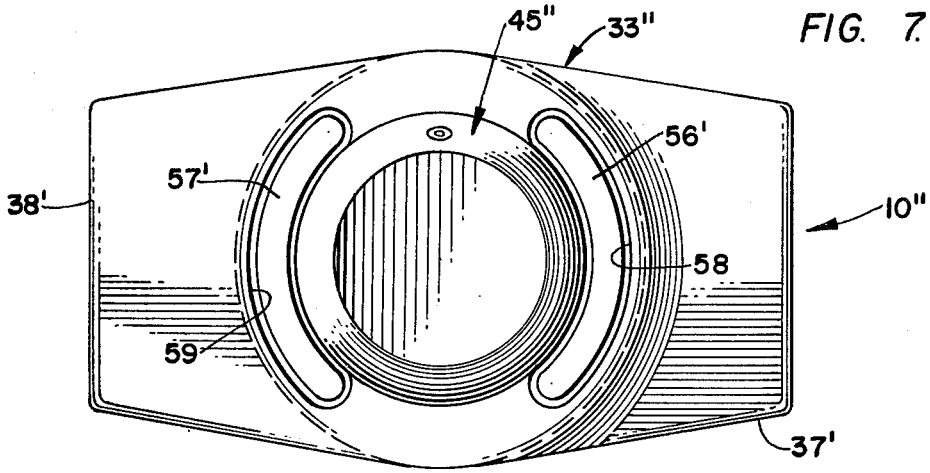
FIG. 7 is a plan view of a third form of dispensing device according to the invention.
Figure 8:
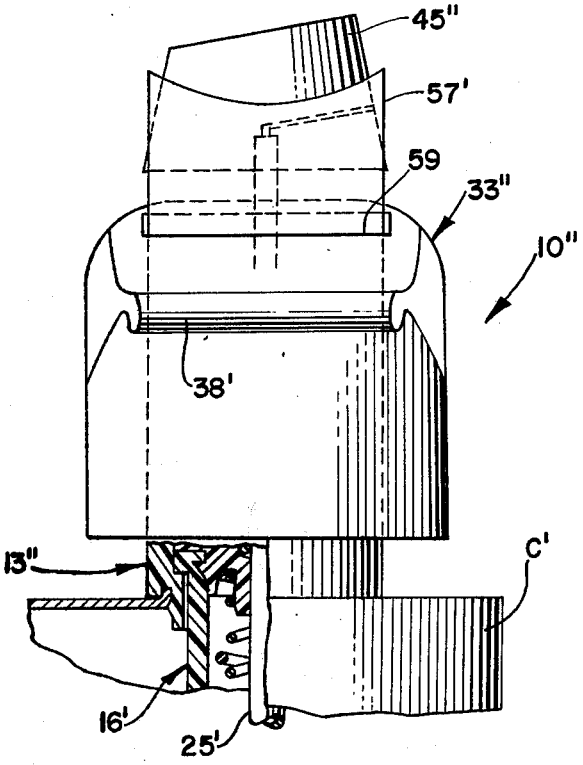
FIG. 8 is a fragmentary view in elevation, with parts in section, of the form of dispenser in FIG. 7.
Figure 9:
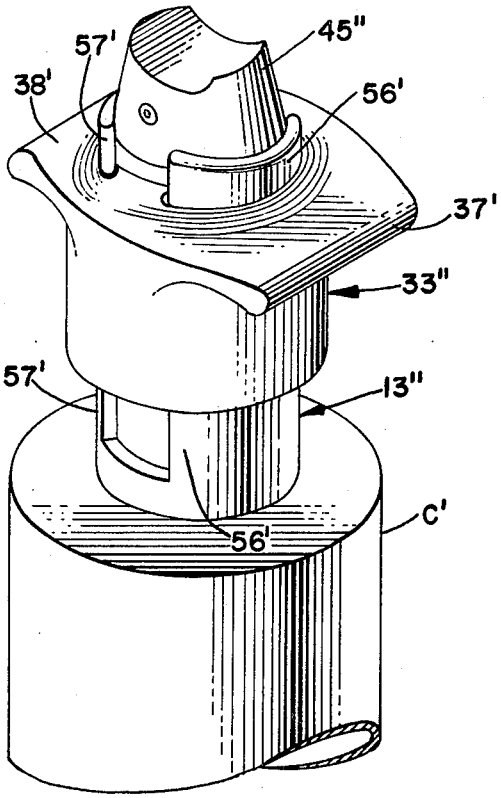
FIG. 9 is a fragmentary perspective view of the invention of FIGS. 7 and 8.

A second form of the invention is indicated generally at 10' in FIGS. 4, 5 and 6 and is generally the same as that described in FIGS. 1–3, except that rather than the rib and channel configuration 39 and 40, the cap 13' has a pair of arcuately shaped, upstanding guide lugs 56 and 57 thereon which extend through aligned, correspondingly shaped guide openings 58 and 59 in the top wall 35 of pull cap or actuator 33'. Additionally, the discharge nozzle or spray device 45' is substantially larger in diameter and is guided between the upstanding lugs 56 and 57. In all other respects, this form of the invention functions identically to that previously described.

It should be understood that a tension spring could be connected with the lower end of rod or stem 25 to return it to its downward position, rather than the collar 30 and spring 31, as specifically described and illustrated. This, for example, may allow a greater upward travel of the rod to charge more material into the reservoir 16. Additionally, rather than use a return spring to return the rod and overcap 33 or 33' downwardly to their original position, the overcap could be manually pushed downwardly and then turned through a small arc to lock it in the down position.

With the present invention, it can readily be seen that a simple and economical structure is provided which is capable of effecting a prolonged discharge of material at a sufficient pressure to produce a fine spray mist. In fact, with a piston 27 having a diameter of about ½ inch, and with the spring 32 exerting about 10 pounds of force, a pressure of approximately 50 psi can be generated. In connection with the assembly of the device, it should be understood that if the bottom wall 18 of chamber 16 were made separate, it could then be suitably secured to the bottom end of chamber 16, or the upper end of side wall 17 of the chamber 16 could be made separately from the cap 13 and then suitably secured to the underside of top wall 14 of the cap in a conventional manner.

A third form 10'' of a dispensing device according to the invention is illustrated in FIGS. 7–10 and is similar to that form of the invention illustrated in FIGS. 4, 5 and 6. However, in this form of the invention the dispensing device 10'' is attached to a can or other like container C', rather than to a bottle or the like as illustrated in the previously described forms of the invention.

More particularly, the dispensing device 10'' comprises a cap member 13'' having upstanding lugs or ears 56' and 57' thereon and a tubular reservoir 16' projecting downwardly therefrom into the interior of the can C'. Additionally, a pull cap 33'' is reciprocable relative to the cap 13'' and has a pair of arcuate slots or openings 58 and 59 formed in the top wall 35' thereof through which the ears or lugs 56' and 57' are received. Additionally, laterally projecting finger grip wings 37' and 38' are formed on the overcap 33' to facilitate manual manipulation thereof.

The cap 13'' has an open bottom 60 with a downwardly projecting cylindrical skirt or flange 61 formed thereon and with a locking rib 62 projecting outwardly in partially enclosing relationship to a channel 63 formed in the bottom end surface of the cap 13'', whereby an upturned lip or rim 64 on the can C' is engaged in the channel 63 and locked therein to secure the cap 13'' and associated components carried thereby to the can C'. A bottom plug or wall 65 is suitably secured in the open bottom 60 of cap 13'' and has a central bore or passage 66 formed therethrough. The passage 66 is enlarged at 67 defining a channel in which an O-ring seal 68 is received. The closure or plug 65 has a downwardly projecting locking rim or flange 69 formed thereon with a sawtooth-shaped locking rib 70 on the outer suface thereof for cooperation with the upper flanged end 71 of the reservoir 16' to secure the reservoir in operative relationship relative to the cap 13''.

Figure 10:
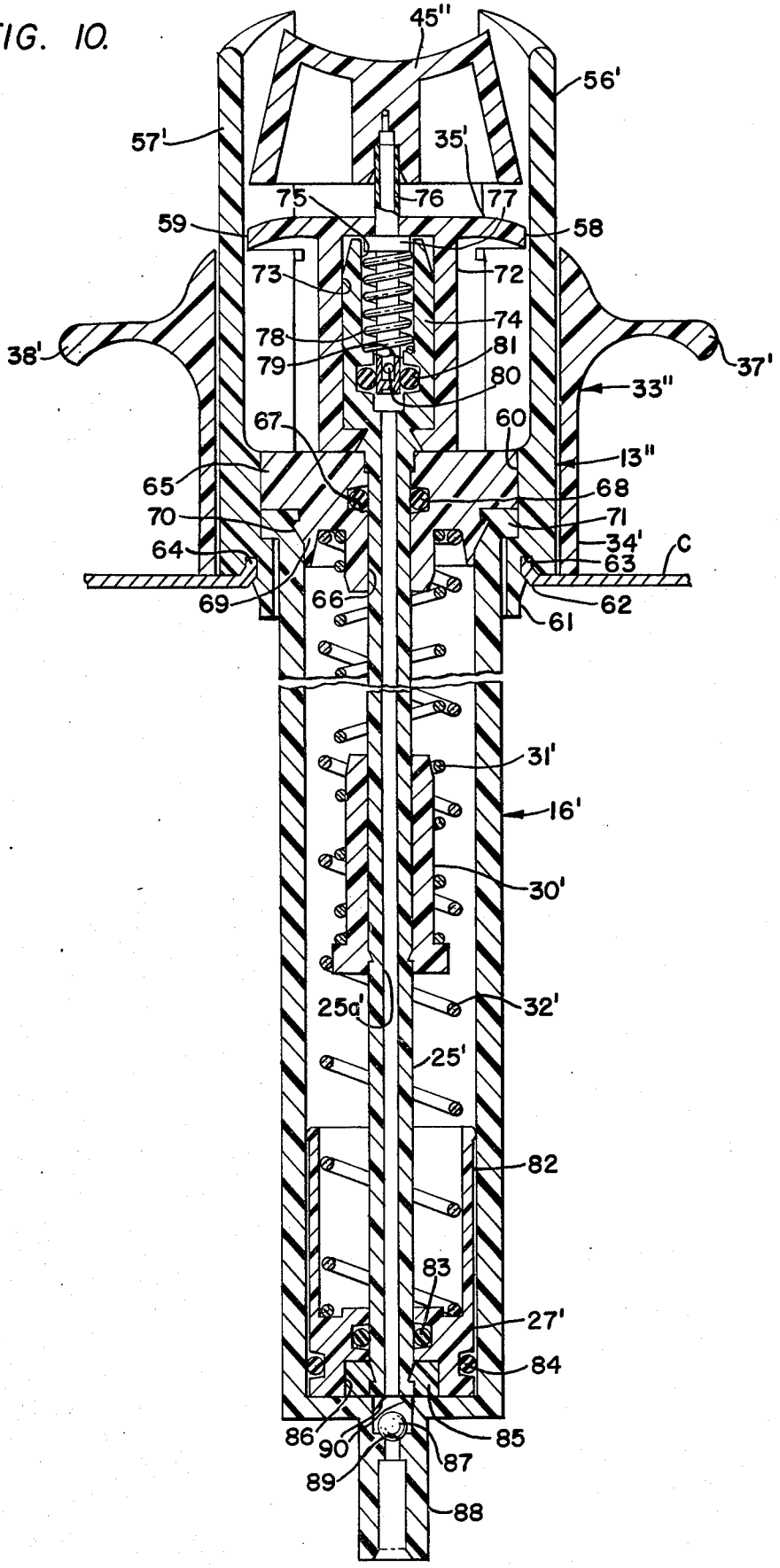
FIG. 10 is an enlarged view in section of the dispensing device of FIGS. 7-9.

The overcap 33'' has a downwardly extending cylindrical wall 72 defining a chamber 73 in which an enlarged upper end 74 of the actuating rod or tube 25' is received. The enlarged end 74 has a hollow chamber 75 therein in which the stem 76 of the discharge device 45'' is axially reciprocably received. As in the previous forms of the invention, the stem has an enlarged collar 77 thereon between its ends and serves as a spring stop for a spring 78 engaged between the collar and a shoulder formed in the bore or chamber 75. The stem 76 has an axial passageway 79 extending therethrough and communicating with a lateral bore or passage 80 adjacent the lower end. An O-ring seal 81 cooperates with the stem 76 such that when the dispensing nozzle 45'' is in its normal upward position, as shown in FIG. 10, the lateral bore or passageway 80 is above the O-ring 81 and flow is not enabled from the reservoir 16' through the stem 76 and the discharge nozzle to atmosphere. However, when the discharge device or nozzle 45'' is depressed with the finger, the passage 80 is positioned below the O-ring 81 and the pressurized contents in the reservoir 16' are thus in communication with the axial passage 79 through stem 76 and through the discharge nozzle 45'' to atmosphere.

The tubular actuating rod 25' extends downwardly from the enlarged upper end 74 thereof through the passage 66 and coaxially through the reservoir 16'. A spring retaining flanged member 30' is secured to the actuating rod 25' between the ends thereof and serves as a spring stop for a first spring 31' engaged therewith and with the underside of plug or bottom wall 65 of the cap 31'' for returning the actuating rod 25' and the pull cap or overcap 33'' downwardly. A piston 27' is received on the actuating rod 25' at its lower end and includes an upwardly extending cylindrical skirt 82, an inner O-ring seal 83 for sealing engagement with the actuating rod 25' and an outer O-ring seal 84 for sealing engagement with the inner wall surface of the reservoir 16'. A piston retainer or stop 85 is secured on the lower end of the actuating rod 25' and is received in a correspondingly shaped cavity 86 in the underside of the piston 27'. A coil spring 32' engaged between the piston 27' and the plug or wall 65 normally urges the piston downwardly into engagement with the bottom end of reservoir 16', as seen in FIG. 10. However, when the overcap 33" is pulled upwardly, the actuating rod 25' is pulled upwardly, pulling the piston 27' therewith and reducing the pressure in the reservoir 16' beneath the piston. A check ball valve 87 is reciprocable in a valve chamber formed in a downwardly extending projection 88 on the lower end of reservoir 16' and moves between a seat 89 and a plurality of radially inwardly projecting lugs or stops 90. Upward movement of the piston 27' and the resultant low pressure in the reservoir 16' causes material in the container C' to flow upwardly past the ball valve 87 into the reservoir beneath the piston. Release of the overcap 33" enables the spring 31' to return the actuating rod 25' and thus the overcap 33" downwardly to that position shown in FIG. 10. However, the piston 27' by virtue of the material trapped therebeneath remains in an upward position with the spring 32' compressed. Thus, subsequent operation of the dispensing device or nozzle 45" establishes communication between passage 80 and the reservoir beneath piston 27' enabling discharge of the contents thereof. The valve 87 may have leak passage means associated therewith, as in the previously described forms of the invention, and a dip tube (not shown) may be connected with the projection 88.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A dispensing device for dispensing material under pressure, comprises: a cap having fastening means thereon for attachment of the cap to an open end of a container of the material to be dispensed, said cap having an end wall for closing the open end of the container; an accumulating chamber carried by the cap in a position to extend through the container open end and into the container when the cap is fastened to the container; a piston reciprocable in the accumulating chamber for alternately drawing material into the accumulating chamber and then pressurizing the material to dispense it; a piston actuating rod connected with the piston and extending through the accumulating chamber; manually engageable piston actuating means outside the container and connected with the piston actuating rod to pull the rod and piston in a first direction outwardly relative to the container to enlarge the accumulating chamber volume and draw material from the container into the accumulating chamber; spring means engaged with the piston urging it in a second direction to pressurize material drawn into the accumulating chamber, said piston being movable in the second direction independently of the actuating rod; and discharge nozzle means connected with the accumulating chamber for selectively releasing the pressurized contents of the chamber.

2. A dispensing device as in claim 1, wherein the piston actuating rod is tubular and extends coaxially into the accumulating chamber in spaced relation to the wall of the accumulating chamber, said piston being annular and reciprocable in the space between the rod and chamber wall.

3. A dispensing device as in claim 2, wherein a spring is engaged with the actuating rod to return it in the second direction to an at-rest position.

4. A dispensing device as in claim 2, wherein a one-way valve is in a wall of the accumulating chamber to enable flow from the container into the chamber but prevent reverse flow through the valve back into the container.

5. A dispensing device as in claim 4, wherein a leak passage is in the one-way valve to permit slow leakage of pressurized material from the accumulating chamber back to the container.

6. A dispensing device as in claim 2, wherein the tubular actuating rod comprises a fluid flow passage for flow of pressurized material from the accumulating chamber to the discharge nozzle means.

7. A dispensing device as in claim 1, wherein the piston actuating means comprises a cup-shaped member telescoped over the cap and said actuating rod is connected with the cup-shaped member and extends through an opening in the cap.

8. A dispensing device as in claim 7, wherein the cup-shaped member and cap have interengaging means thereon preventing relative rotation therebetween.

9. A dispensing device as in claim 2, wherein the rod has a diametrically enlarged flange on the end thereof disposed in the accumulating chamber, said flange comprising a stop to retain the piston on the rod.

10. A dispensing device as in claim 2, wherein the tubular actuating rod comprises a fluid flow passage for flow of pressurized material from the accumulating chamber to the discharge nozzle means, the piston actuating means comprises a cup-shaped member telescoped over the cap, and said actuating rod is threadably connected with the cup-shaped member and extends through an opening in the cap.

11. A dispensing device as in claim 10, wherein the cup-shaped member and cap have interengaging means thereon preventing relative rotation therebetween, said interengaging means comprising a rib and channel configuration in the cup-shaped member and cap.

12. A dispensing device as in claim 10, wherein the cup-shaped member and cap have interengaging means thereon preventing relative rotation therebetween, said interengaging means comprising upstanding lug means on the cap extending through aligned, correspondingly shaped opening means in the cup-shaped member.

13. A dispensing device as in claim 12, wherein the cap has thread means thereon for cooperating association with thread means on a container to secure the cap and the dispensing device to the container.

14. A dispensing device as in claim 12, wherein the cap has channel means therein with an associated locking rib to crimp and secure the dispensing device to an upstanding annular lip of a can .

15. A dispensing device as in claim 14, wherein the cap defines a cylindrical chamber therewithin and the discharge nozzle means has a downwardly axially projecting stem reciprocable in the chamber, seal means engaged between the stem and the chamber wall for providing a sliding seal therebetween, said stem having an axial passage therethrough communicating with a discharge nozzle at one end and with a lateral bore at the other end, said lateral bore being selectively positionable above or below the seal means to prevent or enable discharge of material from the accumulating chamber through the valve actuating rod and stem to the discharge nozzle.

16. A dispensing device as in claim 1, wherein the cap defines a cylindrical chamber therewithin and the discharge nozzle means has a downwardly axially projecting stem reciprocable in the chamber, seal means engaged between the stem and the chamber wall for providing a sliding seal therebetween, said stem having an axial passage therethrough communicating with a discharge nozzle at one end and with a lateral bore at the other end, said lateral bore being selectively positionable above or below the seal means to prevent or enable discharge of material from the accumulating chamber through the valve actuating rod and stem to the discharge nozzle.

17. A dispensing device for dispensing material under pressure, comprises: a cap having fastening means thereon for attachment of the cap to an open end of a container of the material to be dispensed, said cap having an end wall for closing the open end of the container; an accumulating chamber carried by the cap; a piston reciprocable in the accumulating chamber for alternately drawing material into the accumulating chamber and then pressurizing the material to dispense it; a piston actuating rod connected with the piston and extending through the accumulating chamber and through the cap to outside the container; reciprocable, manually engageable piston actuating means outside the container and connected with the piston actuating rod to reciprocate the rod and piston in a first direction to draw material from the container into the accumulating chamber; spring means engaged with the piston urging it in a second direction to pressurize material drawn into the accumulating chamber, said piston and rod each being movable in the second direction independently of the other, in any reciprocated position thereof between fully extended positions; and discharge nozzle means connected with the accumulating chamber for selectively releasing the pressurized contents of the chamber.

18. A dispensing device as in claim 17, wherein the actuator comprises an inverted, cup-shaped member telescopically received over the cap, and said piston rod is secured to the actuator through an opening in the cap.

19. A dispensing device as in claim 18, wherein interengaging guide means is on the cap and actuator to prevent relative rotation therebetween.

20. A dispensing device as in claim 19, wherein the accumulating chamber comprises an elongate cylinder carried by and depending from the cap into the container, said piston rod comprises an elongate tubular member extending coaxially into the accumulating chamber cylinder in radially inwardly spaced relationship to the accumulating chamber cylinder wall and defining a flow passage for material from the accumulating chamber, and opening at its lower end into the accumulating chamber when the piston rod is in its at-rest position, said piston comprising an annular member sealably and slidably engaged in the space between the piston rod and accumulating cylinder wall, spring means engaged with the piston rod urging it in said second direction, whereby after the piston rod has been moved in the first direction it is returned by the spring means to its at-rest position, and piston retaining means on the end of the piston rod to prevent movement of the piston from the piston rod.

* * * * *